US010299030B2

(12) United States Patent
Zhong et al.

(10) Patent No.: US 10,299,030 B2
(45) Date of Patent: May 21, 2019

(54) SPEAKER MODULE WITH SEALED CAVITY AND A COMMUNICATING HOLE

(71) Applicant: GOERTEK INC., WeiFang (CN)

(72) Inventors: Mingjie Zhong, WeiFang (CN); Xinxiang Huo, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/549,043

(22) PCT Filed: Dec. 24, 2015

(86) PCT No.: PCT/CN2015/098728

§ 371 (c)(1),
(2) Date: Aug. 4, 2017

(87) PCT Pub. No.: WO2016/150216

PCT Pub. Date: Sep. 29, 2016

(65) Prior Publication Data

US 2018/0035198 A1 Feb. 1, 2018

(30) Foreign Application Priority Data

Mar. 25, 2015 (CN) ..... 2015 1 0134528

(51) Int. Cl.
*H04R 1/20* (2006.01)
*H04R 1/02* (2006.01)
(Continued)

(52) U.S. Cl.
CPC ..... *H04R 1/20* (2013.01); *H04R 1/02* (2013.01); *H04R 1/06* (2013.01); *H04R 1/2873* (2013.01); *H04R 9/025* (2013.01); *H04R 9/06* (2013.01)

(58) Field of Classification Search
CPC ..... H04R 1/02; H04R 1/2823; H04R 1/2846; H04R 1/2815; H04R 1/2838; H04R 1/20; H04R 1/06; H04R 1/2876
See application file for complete search history.

(56) References Cited

U.S. PATENT DOCUMENTS 3,418,437 A * 12/1968 Hoffmann ..... H04R 1/22 181/160
4,239,945 A * 12/1980 Atoji ..... H04R 1/2819 381/349
(Continued)

FOREIGN PATENT DOCUMENTS

CN 2812463 Y 8/2006
CN 2812464 Y 8/2006
(Continued)

OTHER PUBLICATIONS

Office Action from Chinese Patent Office for Application No. 201510134528.2 dated Aug. 2, 2017.
(Continued)

*Primary Examiner* — Fan S Tsang
*Assistant Examiner* — Angelica M McKinney

(57) ABSTRACT

Provided is a speaker module, comprising a sound passage of a front cavity, wherein the sound passage is defined by a speaker unit, a housing and a sound hole provided on the housing, wherein the speaker module further comprises a sealed cavity and a communication hole, wherein the sealed cavity is provided on a side wall of the sound passage of the front cavity, and the sealed cavity is in communication with the sound passage of the front cavity via the communication hole. By means of the present invention, an SPL peak at Fh and harmonic distortion caused by front cavity resonance can be reduced, so that the acoustic performance of a speaker is enhanced, and the sound quality is improved.

11 Claims, 4 Drawing Sheets

(51) Int. Cl.

| | |
|---|---|
| ***H04R 1/06*** | (2006.01) |
| ***H04R 9/02*** | (2006.01) |
| ***H04R 9/06*** | (2006.01) |
| ***H04R 1/28*** | (2006.01) |

(56) References Cited

U.S. PATENT DOCUMENTS

| | | | | |
|---|---|---|---|---|
| 5,210,793 | A * | 5/1993 | Carlson | H04M 1/03 379/429 |
| 6,490,361 | B1 * | 12/2002 | Klein | H04M 1/03 381/345 |
| 9,799,317 | B2 * | 10/2017 | Winker | G10K 11/16 |
| 9,883,280 | B2 * | 1/2018 | Oosato | H04R 1/2826 |
| 2002/0153193 | A1 | 10/2002 | Toki | |
| 2006/0171551 | A1 * | 8/2006 | Klein | H04M 1/035 381/351 |
| 2013/0343594 | A1 * | 12/2013 | Howes | H04R 1/1016 381/380 |
| 2016/0192065 | A1 * | 6/2016 | Oosato | H04R 1/2826 381/378 |
| 2017/0353783 | A1 * | 12/2017 | Hou | H04R 1/2803 |

FOREIGN PATENT DOCUMENTS

| | | | |
|---|---|---|---|
| CN | 102857849 | A | 1/2013 |
| CN | 103108269 | A | 5/2013 |
| CN | 103347228 | A | 10/2013 |
| CN | 103533472 | A | 1/2014 |
| CN | 203608325 | U | 5/2014 |
| CN | 104754454 | A | 7/2015 |
| CN | 204634015 | U | 9/2015 |
| JP | 2012-249187 | A | 12/2012 |

OTHER PUBLICATIONS

Office Action from Chinese Patent Office for Application No. 201510134528.2, dated Mar. 2, 2018.

International Search Report for International Patent Application No. PCT/CN2015/098728, filed on Dec. 24, 2015.

* cited by examiner

SPEAKER MODULE WITH SEALED CAVITY AND A COMMUNICATING HOLE

CROSS-REFERENCE TO RELATED APPLICATIONS

The present specification is a U.S. National Stage of International Patent Application No. PCT/CN2015/098728, filed Dec. 24, 2015, which claims priority to and the benefit of Chinese Patent Application No. 201510134528.2, filed Mar. 25, 2015, the entire contents of which are incorporated herein by reference.

TECHNICAL FIELD

The present invention relates to the technical field of electroacoustic conversion, more specifically, to a speaker module.

BACKGROUND ART

Speaker is a common electroacoustic transducer for converting electric energy into acoustic energy, and its sound quality is one of the important indicators for measuring the quality of the speaker. In the existing speaker, especially for the speaker module emitting sound at a lateral side, it will inevitably have the problems of sharp and distorted sound caused by lower resonant point in the front cavity, higher SPL of resonant point, higher THD and so on. In order to achieve a euphonic sound quality, the SPL (sound pressure level) corresponding to Fh cannot be too high. Otherwise, the sound will be sharper at Fh, thus affecting the sound effect of the entire speaker module.

In order to reduce the SPL corresponding to Fh, it is common practice to increase the damping by attaching sound absorbing material in the front cavity of the speaker module or other methods, however, which will correspondingly reduce the SPL in other frequency bands, especially the SPL of the frequency band in the vicinity of f0.

SUMMARY

In view of the above problems, the objective of the present invention is to provide a speaker module for reducing the SPL at Fh and the harmonic distortion caused by the cavity structure, and improving the acoustic performance and the sound quality of the speaker.

A speaker module provided by the present invention comprises: a sound passage of a front cavity, wherein the sound passage is defined by a speaker unit, a housing and a sound hole provided on the housing, wherein the speaker module further comprises a sealed cavity and a communication hole, wherein the sealed cavity is provided on a side wall of the sound passage of the front cavity, and the sealed cavity is in communication with the sound passage of the front cavity through the communication hole.

Wherein the speaker module is a speaker module emitting sound at a lateral side thereof.

Wherein the diameter of the communication hole is 0.3 mm to 1.5 mm.

Wherein the length of the communication hole is 0.4 mm to 0.8 mm.

Wherein the volume of the sealed cavity is 0.008 cc to 0.1 cc.

Wherein the number of the communication holes is 1 to 5.

Wherein the number of the sealed cavities is at least one.

Wherein the communication hole is located at an arbitrary position on the side wall of the sound passage of the front cavity.

Wherein the housing comprises an upper module housing and a lower module housing, and the speaker unit is accommodated in a space defined by the upper module housing and the lower module housing.

With the speaker module according to the present invention described above, by providing a sealed cavity on the side wall of the sound passage of the front cavity, and then connecting the sealed cavity and the sound passage of the front cavity through the communication hole, the sealed cavity and the sound passage of the front cavity form a resonant energy absorption structure, so as to filter out some of the high-frequency sound waves, thereby reducing the SPL at Fh and improving the harmonic distortion caused by the cavity structure. The present invention can improve the acoustic performance and sound quality effect of the speaker. The principle thereof is to form a Helmholtz resonator by the sealed cavity and the communication hole, which absorbs parts of the acoustic energy by resonating with the incident sound waves at Fh, so as to filter and absorb sound. The resonant frequency is calculated as follows:

$$f = f_r = \frac{1}{2\pi}\sqrt{\frac{1}{M_b * C_b}}$$

wherein $$M_b = \frac{l * \rho_0}{S_b}$$

is the acoustic mass of the passage, l is the length of the passage, $S_b$ is the cross-sectional area of the passage, $$C_b = \frac{V_b}{\rho_0 * c_0}$$

is the cavity acoustic capacitance of the resonator, $V_b$ is the volume of the cavity, $c_0$ is the sound velocity, and $\rho_0$ is the air density.

In order to achieve the above and other related objectives, one or more aspects of the present invention comprise those features to be described in detail in the followings and particularly pointed out in the claims. The following descriptions and accompanying drawings describe certain illustrative aspects of the present invention in detail. However, these aspects only illustrate some of the ways in which the principle of the present invention can be used. In addition, the present invention intends to comprise all these aspects and their equivalents.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. In the drawings:

Figure 1:
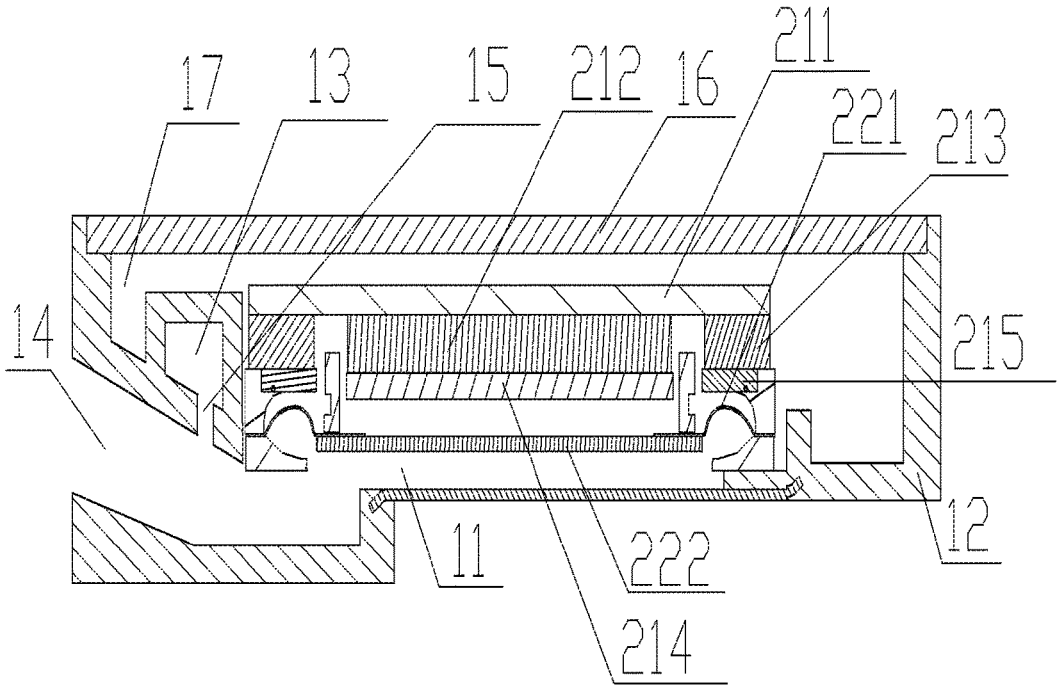
FIG. 1 is a schematic cross-sectional view of the speaker module according to the embodiment of the present invention.

In the drawings: sound passage 11 of front cavity; upper module housing 12; sealed cavity 13; sound hole 14; communication hole 15; lower module housing 16; rear cavity 17; speaker unit 21; yoke 211; center magnet 212; edge magnet 213; center washer 214; edge washer 215; vibrating diaphragm 221; DOME 222.

Same reference numerals in all of the accompanying drawings indicate similar or corresponding features or functions.

DETAILED DESCRIPTION OF EMBODIMENTS

Hereinafter, particular embodiments of the present invention are described in connection with the accompanying drawings.

In view of the above problem that the existing speaker has a higher SPL corresponding to the Fh, which is easy to affect the sound effect of the speaker module, in the present invention, by providing a sealed cavity on the side wall of the sound passage of the front cavity, and then connecting the sealed cavity and the sound passage of the front cavity through the communication hole, the sealed cavity and the sound passage of the front cavity form a resonant energy absorption structure to filter out some of the high-frequency sound waves, thereby reducing the SPL at the Fh and improving the harmonic distortion caused by the cavity structure.

Figure 2:
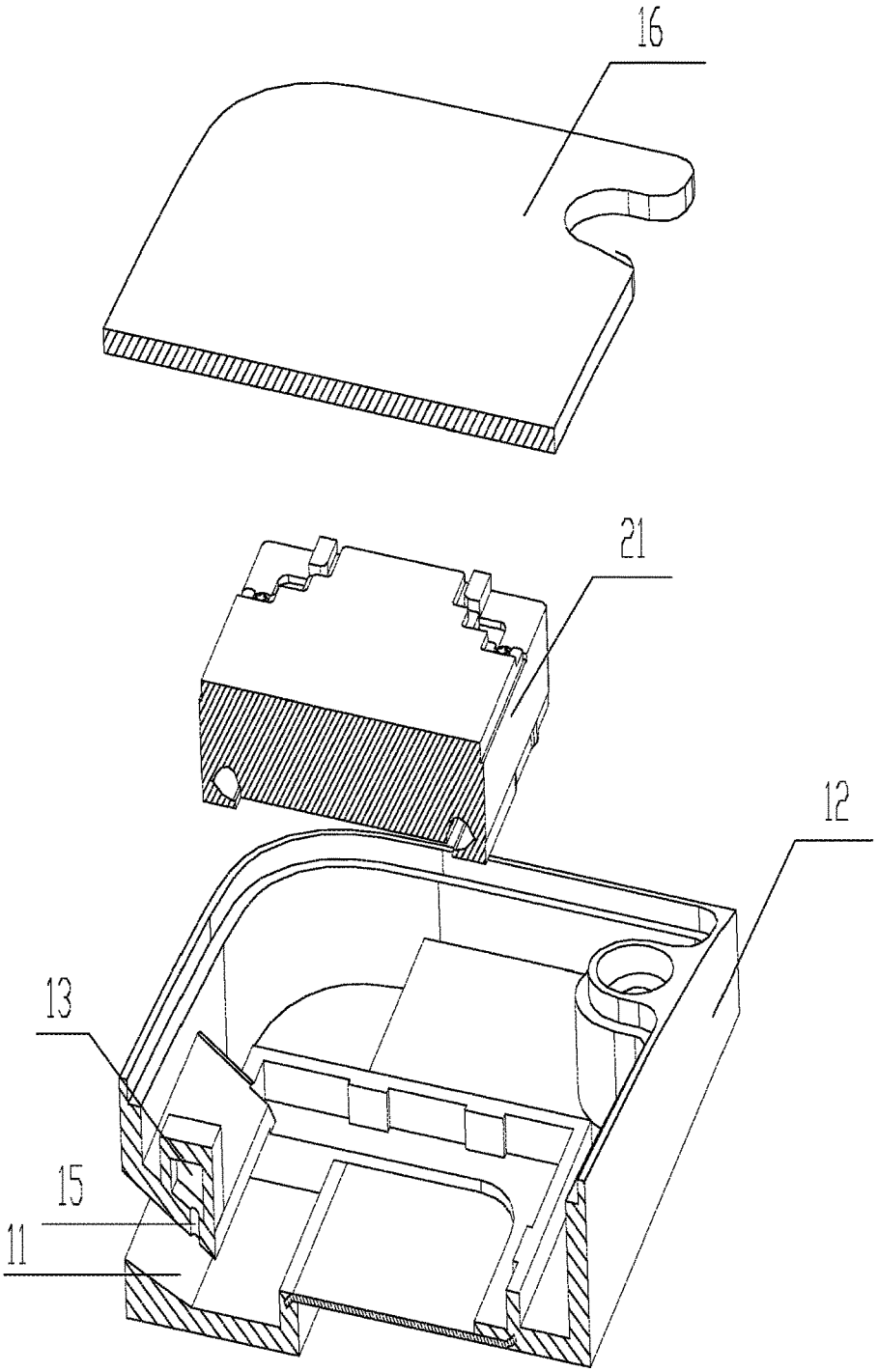
FIG. 2 is a schematic exploded view of the speaker module according to the embodiment of the present invention.

In order to illustrate the speaker module provided by the present invention, FIGS. 1 and 2 show a cross-sectional view and an exploded view of the speaker module according to an embodiment of the present invention, respectively.

As shown in FIGS. 1 and 2, the speaker module of the present invention comprises a speaker unit 21, an upper module housing 12, and a sound hole 14 formed in the upper module housing 12, wherein the space defined by the speaker unit 21, the upper module housing 12 and the sound hole 14 is the sound passage 11 of the front cavity. Wherein, the speaker unit 21 is composed of a vibration system and a magnetic circuit system, wherein the vibration system comprises a vibrating diaphragm 221 and a DOME 222, and the magnetic circuit system comprises a yoke 211, a center magnet 212 provided in the yoke 211, an edge magnet 213 provided at both sides of the center magnet 212, and a center washer 214 and an edge washer 215 disposed on the center magnet 212 and the edge magnet 213 respectively.

In addition, the speaker module provided by the present invention further comprises a lower module housing 16, wherein the sealed space formed by the speaker unit 21 and the lower module housing 16 is the rear cavity 17 of the speaker module, and the space formed by the upper module housing 12 and the lower module housing 16 is used for fixing and accommodating the speaker unit 21. That is, the housing of the speaker module provided by the present invention comprises an upper module housing 12 and a lower module housing 16, and the speaker unit 21 is accommodated in a space formed by the upper module housing 12 and the lower module housing 16.

It should be noted that the vibration system is driven by the magnetic circuit system, and the sound generated by the vibration system is emitted from the sound hole 14 through the sound passage 11 of the front cavity. In order to reduce the SPL corresponding to the Fh, the present invention further comprises a sealed cavity 13 and a communication hole 15. Wherein the sealed cavity 13 is provided on the side wall of the sound passage 11 of the front cavity, and the sealed cavity 13 is in communication with the sound passage 11 of the front cavity through the communication hole 15, so that the sealed cavity 13 forms a resonant energy absorption structure with the sound passage 11 of the front cavity. With the formation of the resonant energy absorption structure, some of the high-frequency sound waves can be filtered out, thereby improving the sound effect of the speaker module.

It should be noted that, as the sound passage 11 of the front cavity is constituted by the space defined by the speaker unit 21, the upper module housing 12 and the sound hole 14, and the sound hole 14 is provided on the upper module housing 12, the sealed cavity 13 provided on the side wall of the sound passage 11 of the front cavity corresponds to being provided on the upper module housing 12.

In addition, it should be noted that, the resonant frequency point is determined by the volume of the sealed cavity and the size of the communication hole connecting the sealed cavity and the sound passage of the front cavity. The position of the communication hole connecting the sealed cavity and the sound passage of the front cavity can be adjusted, and may be any position on the side wall of the sound passage of the front cavity (i.e., the communication hole is located at any position on the side wall of the sound passage of the front cavity), as long as the sealed cavity can be in communication with the sound passage of the front cavity.

In addition, as for the resonant frequency of the resonant energy absorption structure formed by the sealed cavity 13 and the sound passage 11 of the front cavity, it is required to adjust the resonant frequency by combining the actual performance curve of the product, and adjusting the $M_b$ (acoustic mass of the passage) and $C_b$ (acoustic capacitance of the cavity) of the through-hole (i.e., the communication hole) and the cavity (i.e., the sealed cavity). As for the reduction degree of the SPL to the resonant frequency, it is required to adjust the reduction degree of SPL by changing the volume of the cavity while the product of $M_b$ and $C_b$ is invariable. In order to achieve the best effect, a plurality of resonance structures (passage+cavity, that is, a plurality of sealed cavities are provided on the side wall of the sound passage of the front cavity) may be added to fine-tune, which is not described repeatedly herein.

Figure 3:
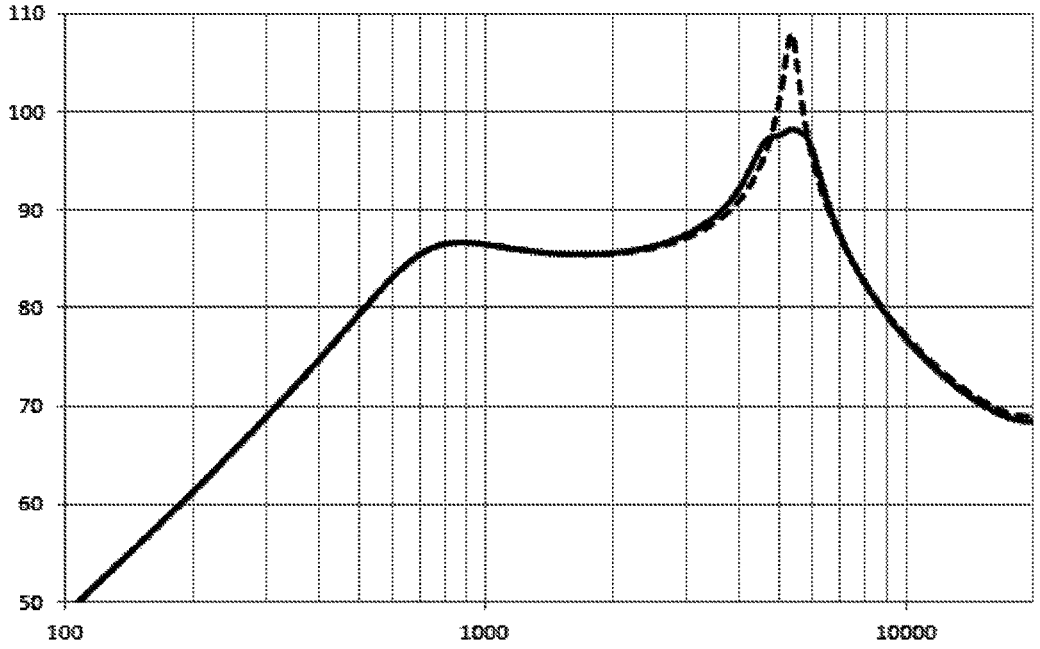
FIG. 3 is a graph showing the variation of the sensitivity test curve (FR curve) before and after adding the sealed cavity.

In a specific embodiment of the present invention, the housing has a thickness of 0.5 mm, and an Fh peak is located at 5.3 kHz. In order to make the curve at Fh relatively flat, two sealed cavities are formed on the side wall of the sound passage of the front cavity to form a resonant energy absorption structure. According to the formula described above, the diameters of the holes formed by the sound passage of the front cavity and the two added sealed cavities are 0.33 mm, and the volumes of the two cavities are that: the volume of a first cavity is 0.009 cc, and the volume of a second cavity is 0.015 cc. The comparison of results is shown in FIG. 3, as can be seen, the sensitivity amplitude difference in f0–Fh segment is significantly reduced.

In addition, it should be noted that, as for the speaker module emitting sound at the lateral side thereof, if the SPL at Fh is too high, the sound will be relatively sharp at the Fh.

In the speaker module provided by the present invention, the SPL at the Fh can be effectively reduced by adding the resonant energy absorption structure on the side wall of the sound passage of the front cavity, and the effect is most obvious especially for the speaker module emitting sound at the lateral side thereof. Thus, the speaker module provided by the present invention may be a speaker module emitting sound at the lateral side thereof, but not limited to such a speaker module.

Hereinafter, the advantageous effects of the speaker module provided by the present invention will be described in detail.

The sealed cavity 13 is added to the side wall of the sound passage 11 of the front cavity of the speaker module, and then the sealed cavity 13 is in communication with the sound passage 11 of the front cavity through the communication hole 15. In its electrical-mechanical-acoustical analogous circuit, the inductor and capacitor form a loop, which may weaken the signal in the vicinity of the resonant frequency, and then play the role of smoothing.

Wherein, FIG. 3 shows the comparison of the FR curves before and after adding the resonant energy absorption structure. In FIG. 3, the abscissa represents the frequency, and the ordinate represents the sound pressure level (SPL). The dashed line is the sensitivity test curve before adding the resonant energy absorption structure, and the solid line is the sensitivity test curve after adding the resonant energy absorption structure. As can be seen from FIG. 3, each of the two sensitivity test curves has two peaks. Obviously, when the frequency is below 1000 (low frequency), the effect of the resonant energy absorption structure on the sound pressure level is negligible. However, when the frequency is in the range of 4000~5000, the sound pressure level is between 100~110 dB before adding the resonant energy absorption structure; and its sound pressure level is reduced to below 100 dB after adding the resonant energy absorption structure.

In addition, as for some cases where the speaker module is distorted due to the front cavity, the harmonic components may be filtered out by adding the sealed cavity 13 on the side wall of the sound passage 11 of the front cavity of the speaker module, and then connecting the sealed cavity 13 and the sound passage 11 of the front cavity through the communication hole 15 (equivalent to adding a filter capacitor in the electrical-mechanical-acoustical analogous circuit), thereby effectively reducing the distortion due to cavity resonance.

Figure 4:
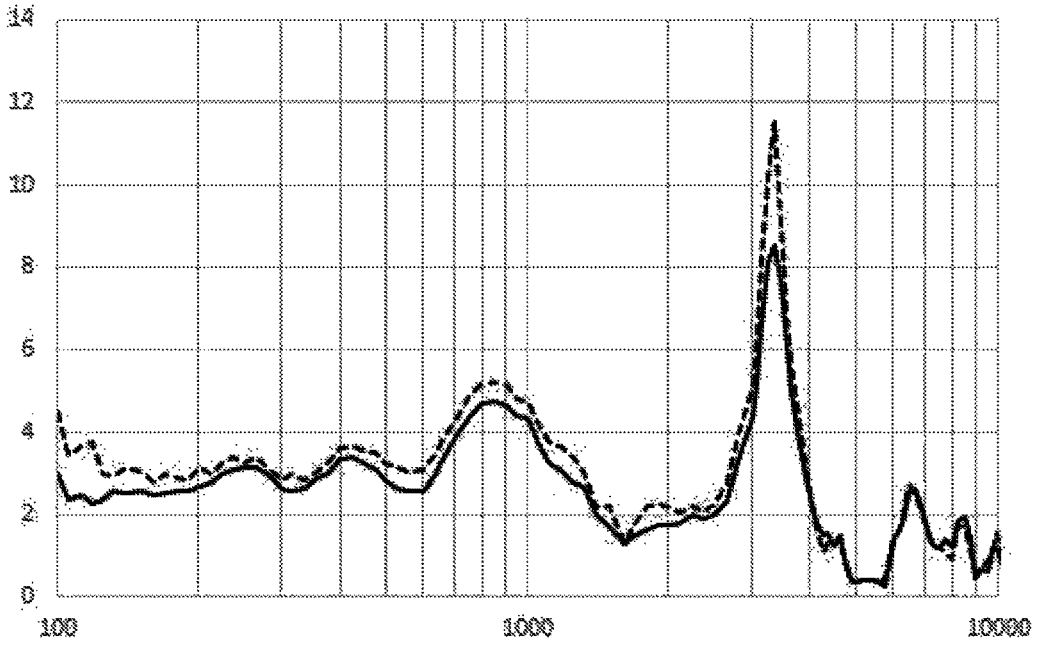
FIG. 4 is a graph showing the change of the distortion test curve (THD curve) before and after adding the sealed cavity.

Wherein, FIG. 4 shows the changes of the distortion test curve (THD curve) before and after adding the resonant energy absorption structure. In FIG. 4, the abscissa represents the frequency, and the ordinate represents the distortion value. The dashed line is the distortion test curve before adding the resonant energy absorption structure, and the solid line is the distortion test curve after adding the resonant energy absorption structure.

As shown in FIG. 4, the highest peaks of the two distortion test curves appear in the same frequency range. However, it is obvious that the distortion will be significantly reduced when the resonant energy absorption structure is added to the side wall of the sound passage of the front cavity of the speaker module.

As described above, the speaker module of the present invention is described by way of example with reference to the accompanying drawings. However, it should be understood by those skilled in the art that various improvements can be made to the speaker module provided by the present invention as described above without depart from the contents of the present invention. Accordingly, the scope of protection of the present invention is determined by the contents of the appended claims.

The invention claimed is:

1. A speaker module, comprising a sound passage of a front cavity, wherein the sound passage is defined by a speaker unit, a housing and a sound hole provided on the housing, wherein the speaker module further comprises a resonant energy absorption cavity and a communication hole, wherein the resonant energy absorption cavity is provided on a side wall of the sound passage of the front cavity, the resonant energy absorption cavity is in communication with the sound passage of the front cavity through the communication hole, wherein a diameter of the communication hole is 0.3 mm to 1.5 mm, and the resonant energy absorption cavity is tuned to absorb energy in one or more frequency of the audible spectrum that is greater than 1000 Hz.

2. The speaker module according to claim 1, wherein the speaker module is a speaker module emitting sound at a lateral side thereof.

3. The speaker module according to claim 1, wherein a length of the communication hole is 0.4 mm to 0.8 mm.

4. The speaker module according to claim 1, wherein a volume of the resonant energy absorption cavity is 0.008 cc to 0.1 cc.

5. The speaker module according to claim 1, wherein a number of the communication holes is 1 to 5.

6. The speaker module according to claim 1, wherein a number of the resonant energy absorption cavities is at least one.

7. The speaker module according to claim 1, wherein the communication hole is located at an arbitrary position on the side wall of the sound passage of the front cavity.

8. The speaker module according to claim 1, wherein the housing comprises an upper module housing and a lower module housing, and the speaker unit is accommodated in a space defined by the upper module housing and the lower module housing.

9. The speaker module according to claim 1, wherein the resonant energy absorption cavity is sealed except for the communication hole.

10. The speaker module according to claim 8, wherein the sidewall separates the upper module housing from the lower module housing.

11. The speaker module according to claim 1, wherein the resonant energy absorption cavity is tuned to attenuate a high peak frequency (Fh) of the speaker module.

* * * * *